US010115334B2

(12) United States Patent
Lin et al.

(10) Patent No.: US 10,115,334 B2
(45) Date of Patent: Oct. 30, 2018

(54) DISPLAY DRIVING CIRCUIT AND DISPLAY DEVICE INCLUDING THE SAME

(71) Applicant: Samsung Electronics Co., Ltd., Suwon-si, Gyeonggi-do (KR)

(72) Inventors: Chiahsin Lin, Hsinchu (TW); Chih-Yang Liao, Taoyuan (TW); Jae Yoon Kim, Seoul (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 59 days.

(21) Appl. No.: 15/290,334

(22) Filed: Oct. 11, 2016

(65) Prior Publication Data

US 2017/0103699 A1 Apr. 13, 2017

(30) Foreign Application Priority Data

Oct. 12, 2015 (KR) ..... 10-2015-0142037

(51) Int. Cl.
*G09G 3/20* (2006.01)

(52) U.S. Cl.
CPC ... *G09G 3/2092* (2013.01); *G09G 2300/0809* (2013.01); *G09G 2310/0251* (2013.01); *G09G 2320/0204* (2013.01); *G09G 2330/00* (2013.01)

(58) Field of Classification Search
CPC ..... G09G 3/2092; G09G 2300/0809; G09G 2310/0251; G09G 2320/0204; G09G 2330/00
See application file for complete search history.

(56) References Cited

U.S. PATENT DOCUMENTS

| | | | | |
|---|---|---|---|---|
| 8,411,012 | B2 | 4/2013 | Liao | |
| 8,619,069 | B2 | 12/2013 | Ko et al. | |
| 8,872,859 | B2 | 10/2014 | Ko et al. | |
| 8,976,164 | B2 | 3/2015 | Liang et al. | |
| 2006/0022932 | A1 | 2/2006 | Sagawa et al. | |
| 2008/0150930 | A1 | 6/2008 | Nam et al. | |
| 2009/0153538 | A1 | 6/2009 | Nakatani et al. | |
| 2009/0231259 | A1 | 9/2009 | Yu et al. | |
| 2011/0199397 | A1 * | 8/2011 | Ko ..... | G09G 3/3688 345/690 |
| 2014/0002438 | A1 | 1/2014 | Higashi et al. | |
| 2014/0298065 | A1 | 10/2014 | Sakamaki | |

FOREIGN PATENT DOCUMENTS

| | | | |
|---|---|---|---|
| JP | 2012022160 | A | 2/2012 |
| KR | 10-1227405 | B1 | 1/2013 |
| KR | 2014-0058166 | A | 5/2014 |

* cited by examiner

*Primary Examiner* — Afroza Chowdhury
(74) *Attorney, Agent, or Firm* — Harness, Dickey & Pierce, P.L.C.

(57) ABSTRACT

A display driving circuit comprising a level shift circuit, the level shift circuit including a level shift device configured to receive a source power applied thereto, and to generate an output signal by amplifying an input signal; a power switching circuit configured to provide any one of first to third selection powers as the source power to the level shift device, the first to third selection powers being different from one another; and a switch control circuit configured to change the first selection power to the second or third selection power based on a change of voltage levels of the first to third selection powers.

14 Claims, 16 Drawing Sheets

| Control Signal | Abnormal off | STB/DSTB | Normal Display |
|---|---|---|---|
| | VOUT=VCI1 | VOUT=VCI | VOUT=VSP |
| | Digital 1/0 | Digital 1/0 | Digital 1/0 |
| SD_VSP_VCISW_A | 1 | 0 | 1 |
| SD_VSP_VCISW_B | 1 | 1 | 0 |
| SD_VSP_VCISW_C | 0 | 1 | 1 |

FIG. 8

| Control Signal | Abnormal off | STB/DSTB | Normal Display |
|---|---|---|---|
| | VOUT=VCI1 | VOUT=VCI | VOUT=VSP |
| | Digital 1/0 | Digital 1/0 | Digital 1/0 |
| SD_VSP_VCISW_A | 1 | 0 | 1 |
| SD_VSP_VCISW_B | 1 | 1 | 0 |
| SD_VSP_VCISW_C | 0 | 1 | 1 |

< Nomal power on/off sequence >

DISPLAY DRIVING CIRCUIT AND DISPLAY DEVICE INCLUDING THE SAME

CROSS-REFERENCE TO RELATED APPLICATIONS

This application is based on and claims priority from Korean Patent Application No. 10-2015-0142037, filed on Oct. 12, 2015 in the Korean Intellectual Property Office, the disclosure of which is incorporated herein in its entirety by reference.

BACKGROUND

The example embodiments of inventive concepts relate to a display driving circuit and a display device including the same.

A display device may include a display driving IC (DDI). With the development of technology, portability of various kinds of electronic devices is increased and the miniaturization thereof is in progress. Further, as the necessity of outputting high-resolution images is increased, great changes have been demanded for a display driving circuit that drives a display panel.

Specifically, the display driving circuit may receive successive image frames from a host, and may control the display panel to display the image frames on a screen.

When the display driving circuit is in an OFF mode, a source output that is input to the display panel may be grounded to discharge cells included in the display panel. However, due to improper power supply, the discharge of the display panel may not be properly performed. In this case, a DC residual effect may occur on the display panel, and an image sticking issue may also occur.

SUMMARY

Some example embodiments of inventive concepts provide a display driving circuit that prevents a DC residual effect or an image sticking issue from occurring on a display panel through proper discharging of a source output even in the case of improper power supply thereto.

Some example embodiments of inventive concepts provide a display device that prevents a DC residual effect or an image sticking issue from occurring on a display panel through proper discharging of a source output even in the case of improper power supply thereto.

Additional advantages, subjects, and features of the example embodiments of inventive concepts will be set forth in part in the description which follows and in part will become apparent to those having ordinary skill in the art upon examination of the following or may be learned from practice of the example embodiments of inventive concepts.

In some example embodiments of inventive concepts, a display driving circuit comprises a level shift circuit, the level shift circuit includes a level shift device, the level shift device configured to receive a source power applied thereto, and configured to generate an output signal by amplifying an input signal; a power switching circuit, the power switching circuit configured to provide any one of first to third selection powers as the source power to the level shift device, the first to third selection powers is different from one another; and a switch control circuit, the switch control circuit configured to change the first selection power to the second or third selection power based on a change of voltage levels of the first to third selection powers.

In some other example embodiments of inventive concepts, a display driving circuit comprises a level shift circuit, the level shift circuit includes, a level shift device, the level shift device configured to receive first and second source powers that are different from each other, and configured to generate an output signal by amplifying an input signal; an operational amplifier configured to output source data to a display panel, and a pull-down transistor configured to be gated by the output signal of the level shift device, and to selectively connect an output terminal of the operational amplifier to a ground terminal; a power switching circuit configured to provide any one of first to third selection powers that are different from one another as the first source power of the level shift device; and a switch control circuit configured to determine an operating mode based on a change of voltage levels of the first and second source powers, and configured to change the first source power applied to the level shift circuit by changing of a control signal for controlling the power switching circuit if the operating mode changes.

In some other example embodiments of inventive concepts, a display device comprising a display panel including a plurality of pixels; and a display driving circuit configured to control the display panel, the display driving circuit includes, a voltage generator configured to receive a power supply voltage from an outside of the display driving circuit and to generate first to third selection powers that are different from each other; a level shift device configured to receive any one of the first to third selection powers, and generate an output signal by amplifying an input signal; a pull-down transistor configured to be gated by the output signal of the level shift device and to selectively connect the display panel to a ground terminal to pull down the plurality of pixels; and a switch control circuit configured to change a selection power that is applied to the level shift circuit to another selection power based on a change of voltage levels of the first to third selection voltages.

In other some example embodiments of inventive concepts, a display device comprising a display panel includes a plurality of gate lines and a plurality of data lines; and a level shift device, the level shift device configured to receive a first source power and a second source power, and configured to generate an output signal by amplifying an input signal; an operational amplifier configured to output source data to the data line of the display panel; a pull-down transistor configured to be gated by the output signal of the level shift device, and selectively connect the plurality of data lines to the ground terminal.

BRIEF DESCRIPTION OF THE DRAWINGS

The above and other objects, features and advantages of example embodiments of inventive concepts will be more apparent from the following detailed description taken in conjunction with the accompanying drawings, in which:

FIG. 8 is a table explaining an operation of a display driving circuit according to some example embodiments of inventive concepts;

DETAILED DESCRIPTION OF THE EMBODIMENTS

Figure 1:
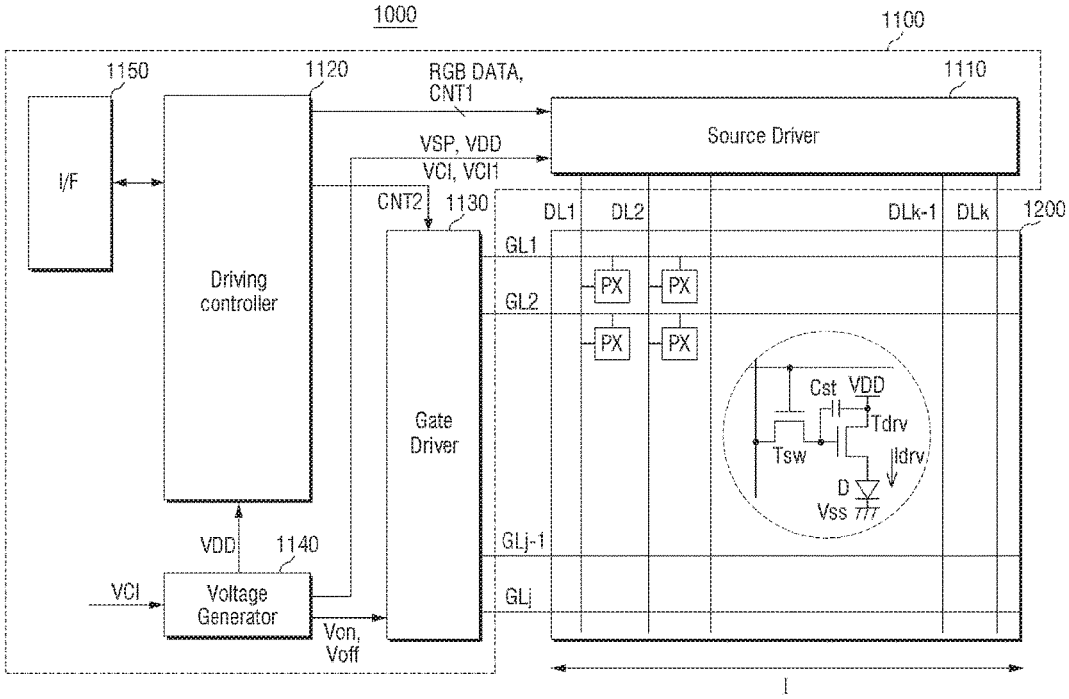
FIG. 1 is a block diagram explaining a display device according to some example embodiments of inventive concepts.

The present invention will now be described more fully hereinafter with reference to the accompanying drawings, in which preferred example embodiments of invention concepts are shown. This invention may, however, be embodied in different forms and should not be construed as limited to the example embodiments set forth herein. Rather, these example embodiments are provided so that this disclosure will be thorough and complete, and will fully convey the scope of the invention to those skilled in the art. The same reference numbers indicate the same components throughout the specification. In the attached figures, the thickness of layers and regions is exaggerated for clarity.

It will also be understood that when a layer is referred to as being "on" another layer or substrate, it can be directly on the other layer or substrate, or intervening layers may also be present. In contrast, when an element is referred to as being "directly on" another element, there are no intervening elements present.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted.

Unless defined otherwise, all technical and scientific terms used herein have the same meaning as commonly understood by one of ordinary skill in the art to which this invention belongs. It is noted that the use of any and all examples, or example terms provided herein is intended merely to better illuminate the invention and is not a limitation on the scope of the invention unless otherwise specified. Further, unless defined otherwise, all terms defined in generally used dictionaries may not be overly interpreted.

The example embodiments of invention will be described with reference to perspective views, cross-sectional views, and/or plan views, in which example embodiments are shown. Thus, the profile of an example view may be modified according to manufacturing techniques and/or allowances. That is, the example embodiments of the invention are not intended to limit the scope of the invention but cover all changes and modifications that can be caused due to a change in manufacturing process. Thus, regions shown in the drawings are illustrated in schematic form and the shapes of the regions are presented simply by way of illustration and not as a limitation.

Hereinafter, a display driving circuit and a display device including the same according to some example embodiments of inventive concepts will be described with reference to FIGS. 1 to 16.

FIG. 1 is a block diagram explaining a display device according to some example embodiments of inventive concepts.

Referring to FIG. 1, a display device 1000 according to some example embodiments of inventive concepts may be any one of various kinds of display devices. For example, the display device 1000 may be an organic light emitting diode display (OLED), a liquid crystal display (LCD), a display panel (DP) device, an electrochromic display (ECD), a digital mirror device (DMD), an actuated mirror device (AMD), a grating light value display (GLV), a plasma display panel (PDP), or an electroluminescent display (ELD).

Further, the display device 1000 according to some example embodiments of inventive concepts may include a display driving circuit 1100 and a display panel 1200.

The display panel 1200 may include pixels that are arranged in the form of a matrix and may display an image in accordance with supplied image data. Here, it is exemplified that the display panel is an organic light emitting panel.

The display panel 1200 includes a plurality of gate lines GL1 to GLj that transfer scan signals in a row direction, a plurality of data lines DL1 to DLk arranged in a direction crossing the gate lines to transfer data signals in a column direction, and a plurality of pixels PX arranged in a region in which the gate lines GL1 to GLj and the data lines DL1 to DLk cross each other.

If the plurality of gate lines GL1 to GLj are successively selected, grayscale voltages are applied to the pixels PX connected to the selected gate lines through the plurality of data lines DL1 to DLk.

Each of the pixels PX may include a switching transistor Tsw, a driving transistor Tdrv, a storage capacitor Cst, and an organic light emitting diode D. The gate line GL and the data line DL are respectively connected to the gate electrode and the source electrode of the switching transistor Tsw, the drain electrode of the switching transistor Tsw and a power supply voltage VDD are respectively connected to the gate terminal and the source terminal of the driving transistor Tdrv, and the drain terminal of the driving transistor Tdrv is connected to the anode of the organic light emitting diode D. In such a pixel structure, if the gate line GL is selected, the switching transistor Tsw is turned on to apply a grayscale voltage that is provided through the data line DL to the gate terminal of the driving transistor Tdrv, and driving current Idrv according to a voltage difference between the driving power supply voltage VDD and the grayscale voltage flows through the organic light emitting diode D, so that the organic light emitting diode D emits light to achieve the display operation.

The display driving circuit 1100 may control the display panel 1200. The display driving circuit 1100 may include a driving controller 1120, a source driver 1110, a gate driver 1130, a voltage generator 1140, and an interface (I/F) 1150.

The driving controller 1120 receives image data and control command from an outside, for example, a host of a system on which the display device 1000 is mounted, and provides control signals CNT1 and CNT2 and pixel data RGB DATA that are required for the operation of the display device to the source driver 1110 and the gate driver 1130.

The source driver 1110 converts the pixel data RGB DATA that is digital data applied from the driving controller 1120 into grayscale voltages, and outputs the grayscale voltages to the data lines DL1 to DLk of the panel 1200. The gate driver 1130 successively scans the gate lines GL1 to GLj of the panel 1200. The gate driver 1130 enables the selected gate lines by applying a gate-on voltage Von to the selected gate lines, and the source driver 1110 outputs grayscale voltages that correspond to the pixels that are connected to the enabled gate lines. Accordingly, the display panel 1200 displays an image in the unit of a horizontal line, that is, row by row.

The voltage generator 1140 receives a power supply voltage VCI from the outside, and generates voltages VSP, VCI, VCI1, VDD, Von, and Voff that are required in the source driver 1120 or the gate driver 1130.

Specifically, the voltage generator 1140 may generate first to third selection powers VSP, VCI, and VCI1 and a logic voltage VDD based on the power supply voltage (e.g., VCI) applied from the outside. The first to third selection voltages VSP, VCI, and VCI1 may be provided to the source driver 1110. Further, the logic voltage VDD may be transferred to the source driver 1110. However, the example embodiments of inventive concepts are not limited thereto.

The interface 1150 is to communicate with the host (e.g., application processor). The interface 1150 receives image data DATA and control commands CMD that are applied in parallel or in series from the host, and provides them to the driving controller 1120. The interface 1150 may be included inside or outside the driving controller 1120.

The interface 1150 may receive the image data DATA and the control commands in accordance with a first protocol method that corresponds to the transmission method of the host. The interface 1150 includes a protocol for performing data exchange between the host and the driving controller 1120. For example, the first protocol that is used in the interface 1150 is configured to communicate with the outside (e.g., host) through at least one of various interface protocols, such as a USB (Universal Serial Bus) protocol, an MMC (Multimedia Card) protocol, a PCI (Peripheral Component Interconnection) protocol, a PCI-E (PCI-Express) protocol, an ATA (Advanced Technology Attachment) protocol, a serial-ATA protocol, a parallel-ATA protocol, a SCSI (Small Computer Small Interface) protocol, an ESDI (Enhanced Small Disk Interface) protocol, an IDE (Integrated Drive Electronics) protocol, a PSI (Service Provider Interface) protocol, a MDDI (Mobile Display Digital Interface) protocol, and a MIPI (Mobile Industry Processor Interface) protocol, but is not limited thereto.

Figure 2:
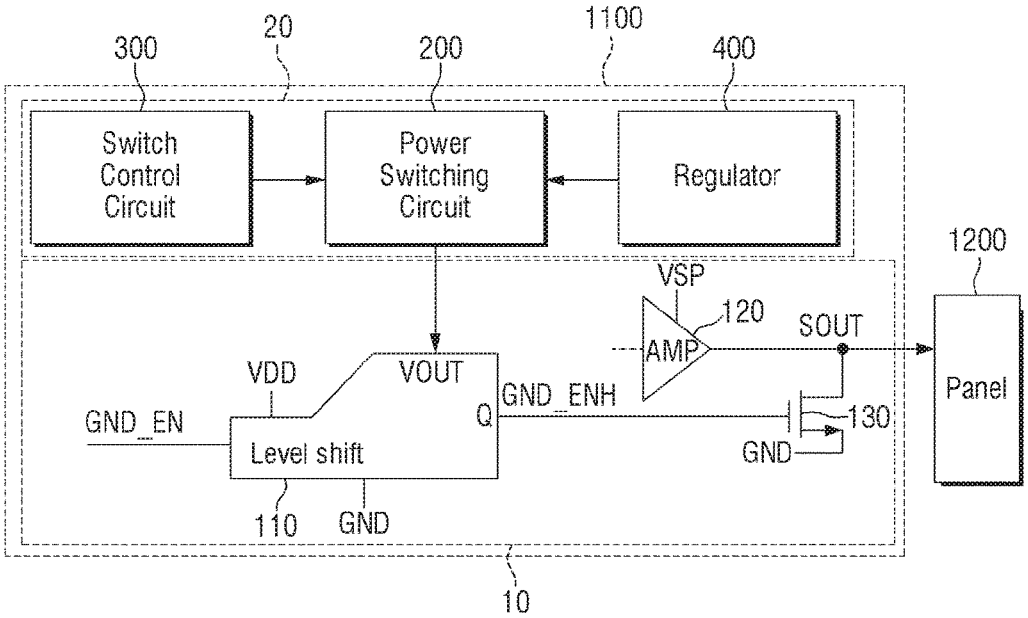
FIG. 2 is a block diagram explaining a display driving circuit according to some example embodiments of inventive concepts.
Figure 3:
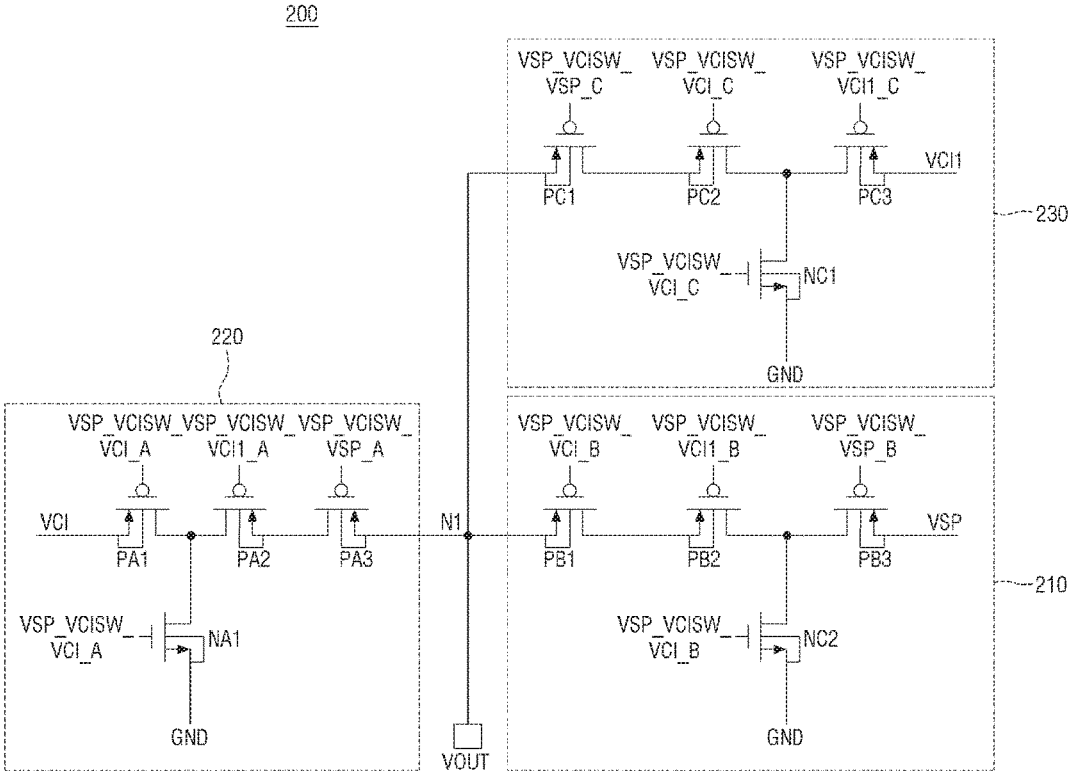
FIG. 3 is a circuit diagram explaining a power switching circuit included in a display driving circuit according to some example embodiments of inventive concepts.
Figure 4:
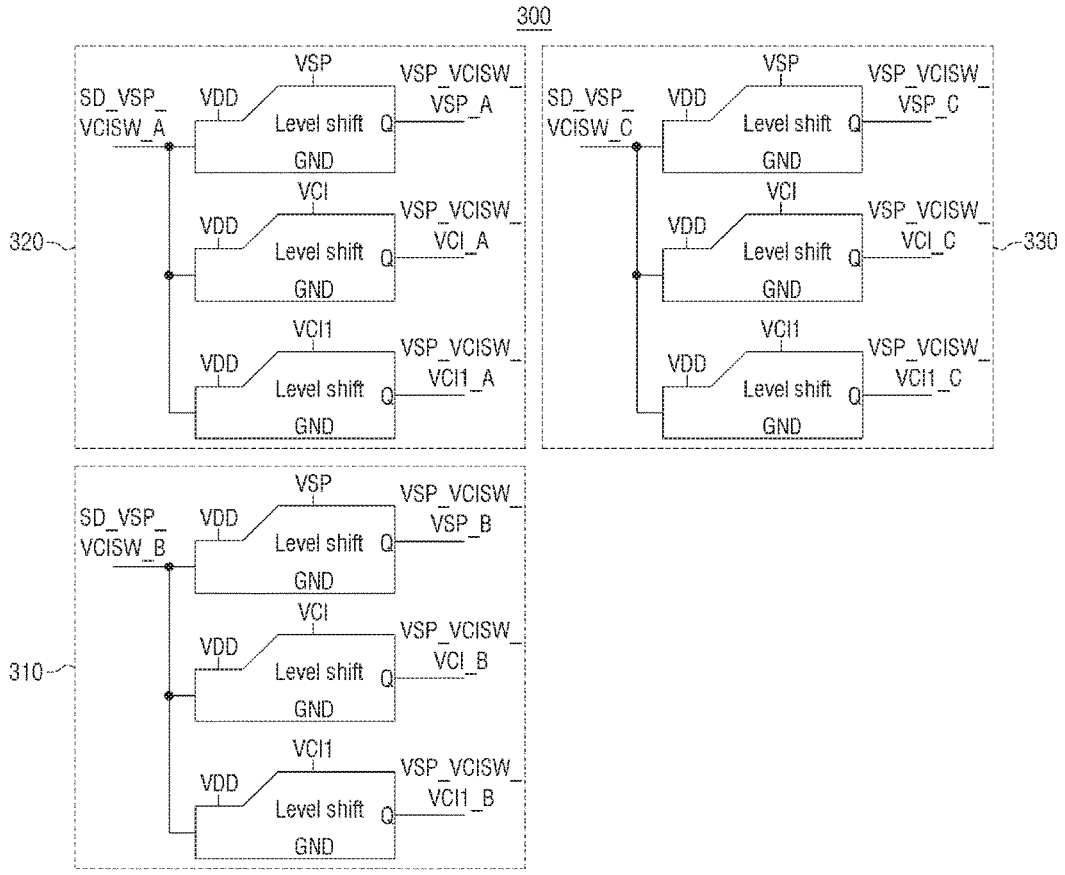
FIG. 4 is a circuit diagram explaining a switch control circuit included in a display driving circuit according to some example embodiments of inventive concepts.
Figure 5:
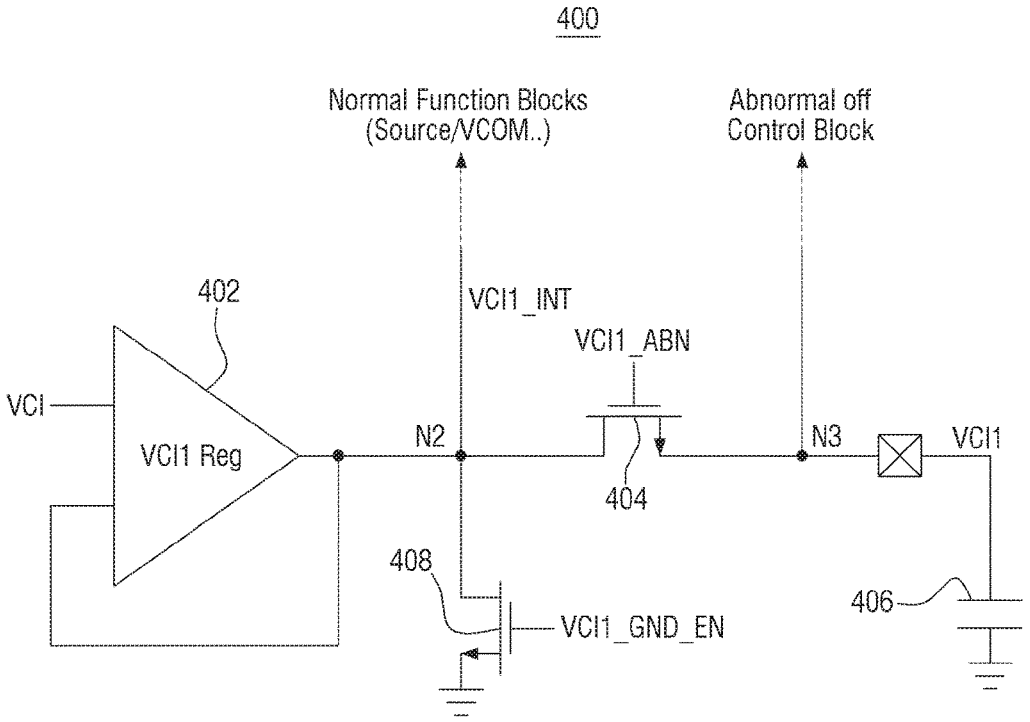
FIG. 5 is a circuit diagram explaining a regulator included in a display driving circuit according to some example embodiments of inventive concepts.

FIG. 2 is a block diagram explaining a display driving circuit according to some example embodiments of inventive concepts. FIG. 3 is a circuit diagram explaining a power switching circuit included in a display driving circuit according to some example embodiments of inventive concepts, FIG. 4 is a circuit diagram explaining a switch control circuit included in a display driving circuit according to some example embodiments of inventive concepts, and FIG. 5 is a circuit diagram explaining a regulator included in a display driving circuit according to some example embodiments of inventive concepts.

Referring to FIG. 2, the display driving circuit 1100 according to some example embodiments of inventive concepts includes a level shift circuit 10 and a pull-down circuit 20.

The level shift circuit 10 may include a level shift device 110, an operational amplifier (OP-AMP) 120, and a pull-down transistor 130.

The level shift device 110 may receive an input signal GND_EN, and may generate an amplified output signal GND_ENH. The level shift device 110 may amplify and output the input signal GND_EN. For example, the level shift device 110 may amplify the input signal GND_EN of 1.2V to the output signal GND_ENH of 5V, but is not limited thereto. The amplification rate of the output signal GND_ENH may differ in accordance with the first source power VOUT or the second source power VDD.

The first source power VOUT and the second source power VDD may be applied to the level shift device 110. For example, any one of the first to third selection powers VSP, VCI, and VCI1 may be applied to the first source power VOUT. Further, the logic voltage VDD may be applied to the second source power VDD. However, the example embodiments of inventive concepts are not limited thereto.

In this case, the power that is applied to the first source power VOUT may be changed in accordance with an operating mode of the display driving circuit 1100. For example, in the case where the display driving circuit 1100 operates in a normal mode and transfers an image to the display panel 1200, the first selection power VSP may be applied to the first source power VOUT. If the operating mode of the display driving circuit 1100 is changed from the normal mode to a standby (STB) mode or a deep-standby (DSTB) mode, the second selection power VCI may be applied to the first source power VOUT. In the case where the operating mode of the display driving circuit 1100 is changed from the normal mode to an abnormal mode, the third selection power VCI1 may be applied to the first source power VOUT. However, the example embodiments of inventive concepts are not limited thereto. The operation of the display driving circuit 1100 will be described in detail later.

The operational amplifier 120 may output source data to the display panel 1200. Although not clearly illustrated in the drawing, the front end of the operational amplifier 120 may convert the pixel data RGB DATA that is digital data into a grayscale voltage and may transfer the grayscale voltage to the operational amplifier 120, and the operational amplifier 120 may amplify the grayscale voltage to transfer source data to the display panel 1200. The source data may include an analog signal.

The pull-down transistor 130 is gated by the output signal GND_ENH of the level shift device 110, and in the case where the pull-down transistor 130 is turned on, the output terminal SOUT of the operational amplifier 120 may be connected to the GNU terminal. In this case, the display panel 1200 is electrically connected to the GND terminal, and thus charge of a plurality of pixels included in the display panel 1200 may be pulled down, that is, may be discharged.

Through this, a DC residual effect is prevented from occurring on the display panel 1200, and image sticking is prevented from occurring on the display panel 1200 in a power-off mode.

The pull-down circuit 20 may apply the appropriate first source power VOUT to the level shift device 110 so as to prevent the DC residual effect from occurring on the display panel 1200.

The pull-down circuit 20 may include a power switching circuit 200, a switch control circuit 300, and a regulator 400.

Referring to FIGS. 2 and 3, the power switching circuit 200 included in the display driving circuit 1100 may provide any one of the first to third selection powers VSP, VCI, and VCI1, which are different from one another, to the first source power VOUT. The power switching circuit 200 may be controlled by the switch control circuit 300. The power switching circuit 200 may be included in the source driver 1110 as described above with reference to FIG. 1, but is not limited thereto.

The power switching circuit 200 may include a first sub-circuit 210, a second sub-circuit 220, and a third sub-circuit 230. Specifically, the power switching circuit 200 may include the first sub-circuit 210 that provides the first selection power VSP to a first node N1 of the level shift device 110 to which the first source power VOUT is applied, the second sub-circuit 220 that provides the second selection power VCI to the first node N1, and the third sub-circuit 230 that provides the third selection power VCI1 to the first node N1. The first to third sub-circuits 210, 220, and 230 may include circuits having substantially the same configuration. Hereinafter, the first sub-circuit 210 will be exemplarily described.

The first sub-circuit 210 may include a first sub-transistor PB3 having one terminal connected to the first selection power VSP, a second sub-transistor PB2 connected in series to the first sub-transistor PB3, a third sub-transistor PB1 having one terminal connected to the second sub-transistor PB2 and the other terminal connected to the first node N1, and a fourth sub-transistor NC2 having one terminal connected between the first sub-transistor PB3 and the second sub-transistor PB2 and the other terminal connected to the GND terminal. In this case, the first to third sub-transistors PB3, PB2, and PB1 may include P-type transistors, and the fourth sub-transistor NC2 may include an N-type transistor.

Further, the first sub-transistor PB3 may be gated by a first control signal VSP_VCISW_VSP_B, the second sub-transistor PB2 may be gated by a second control signal VSP_VCISW_VCI1_B, and the third sub-transistor PB1 may be gated by a third control signal VSP_VCISW_VCI_B. The fourth sub-transistor NC2 may be gated by the third control signal VSP_VCISW_VCI_B. The first to third control signals VSP_VCISW_VSP_B, and VSP_VCISW_VCI_B may be received from the switch control circuit 300 to be described later, but are not limited thereto.

Referring to FIGS. 2 and 4, the switch control circuit 300 included in the display driving circuit 1100 may change the selection power that is transferred to the first node N1 to another selection power through changing of the control signals that are applied to the first to third sub-circuits 210, 220, and 230 based on the change of voltage levels of the first to third selection powers VSP, VCI1, and VCI. The switch control circuit 300 may be included in the source driver 1110 as described above with reference to FIG. 1, but is not limited thereto.

The switch control circuit 300 may include a plurality of level shifters. Specifically, the switch control circuit 300 may include first to third sub-control circuits 310, 320, and 330. The first to third sub-control circuits 310, 320, and 330 may include circuits having substantially the same configuration. Hereinafter, the first sub-control circuit 310 will be exemplarily described.

The first sub-control circuit 310 may include a first sub-level shifter outputting the first control signal VSP_VCISW_VSP_B for gating the first sub-transistor PB3, a second sub-level shifter outputting the second control signal VSP_VCISW_VCI1_B for gating the second sub-transistor PB2, and a third sub-level shifter outputting the third control signal VSP_VCISW_VCI_B for gating the third sub-transistor PB1. In this case, the first to third sub-level shifters may receive the same input signal (e.g., SD_VSP_VCISW_B).

However, the first to third sub-level shifters may receive different selection powers. For example, the first sub-level shifter may receive the first selection power VSP, the second sub-level shifter may receive the third selection power VCI1, and the third sub-level shifter may receive the second selection power VC1. However, the example embodiments of inventive concepts are not limited thereto.

The change of the output voltages of the power switching circuit 200 in accordance with the change of input signals SD_VSP_VCISW_A, SD_VSP_VCISW_B, and SD_VSP_VCISW_C will be described later with reference to FIG. 8.

Referring to FIGS. 2 and 5, the regulator 400 included in the display driving circuit 1100 may generate the third selection power VCI1 based on the second selection power VCI and provide the generated third selection power VCI1 to the power switching circuit 200. The regulator 400 may be included in the voltage generator 1140 as described above with reference to FIG. 1, but is not limited thereto.

The regulator 400 may include an operational amplifier 402 receiving the second selection power VCI and outputting a converted voltage to the second node N2, a first transistor 408 that is gated by substantially the same signal VCI1_GND_EN as the input signal GND_EN of the level shift device 110, a second transistor 404 that is gated by a control signal VCI1_ABN based on the change of the voltage levels of the first to third selection powers VSP, VCI, and VCI1 and transferring the voltage of the second node N2 to the third node N3, and a capacitor 406 connected between the third node N3 and the GND terminal. The voltage of the third node N3 may be provided to the third selection power VCI1.

For example, the operational amplifier 402 may receive the second selection power VCI of 2.8V and may output a voltage of 2.5V. The voltage at an output terminal thereof may be transferred to the second node N2, but is not limited thereto.

The first transistor 408 may be positioned between the second node N2 and the GND terminal. The first transistor 408 may be gated by the substantially the same signal VCI1_GND_EN as the input signal GND_EN that is applied to the level shift device 110. That is, when the input signal GND_EN is applied to the level shift device 110, the first transistor 408 may be turned on. If the first transistor 408 is turned on, the second node N2 may be connected to the GND terminal, and the second node N2 may be pulled down.

The second transistor 404 may be positioned between the second node N2 and the third node N3. The second transistor 404 is gated by the control signal VCI1_ABN, and the control signal VCI1_ABN may be enabled when the display driving circuit 1100 according to the example embodiments of inventive concepts are in a normal mode and may be not enabled when the display driving circuit 1100 is in an abnormal mode.

Accordingly, when the display driving circuit 1100 is in a normal mode, the second transistor 404 may be turned on, and the voltages of the second node N2 and the third node N3 may be equal to each other. In this case, the output of the operational amplifier 402 may be transferred to the third node N3, and the voltage of the third node N3 may be transferred to the third selection power VCK1.

In contrast, when the display driving circuit 1100 is in an abnormal mode, the second transistor 404 may be turned off and the first transistor 408 may be turned on as the input signal GND_EN that is applied to the level shift device 110 is enabled. In this case, the voltage of the second node N2 is connected to the GND terminal to be pulled down, and the voltage of the third node N3 may become equal to the voltage of the charged capacitor 406. The voltage charged in the capacitor 406 may correspond to a floating power, and may be transferred to the third selection power VCI1.

The voltage of the third node N3 may be the third selection power VCI1, and may be transferred to the pull-down circuit 20. For example, the voltage of the third node N3 may be the third selection power VCI1, and may be transferred to the switch control circuit 300 or the power switching circuit 200. The voltage of the second node N2 may be transferred to the remaining circuits included in the display driving circuit 1100, but is not limited thereto.

Figure 6:
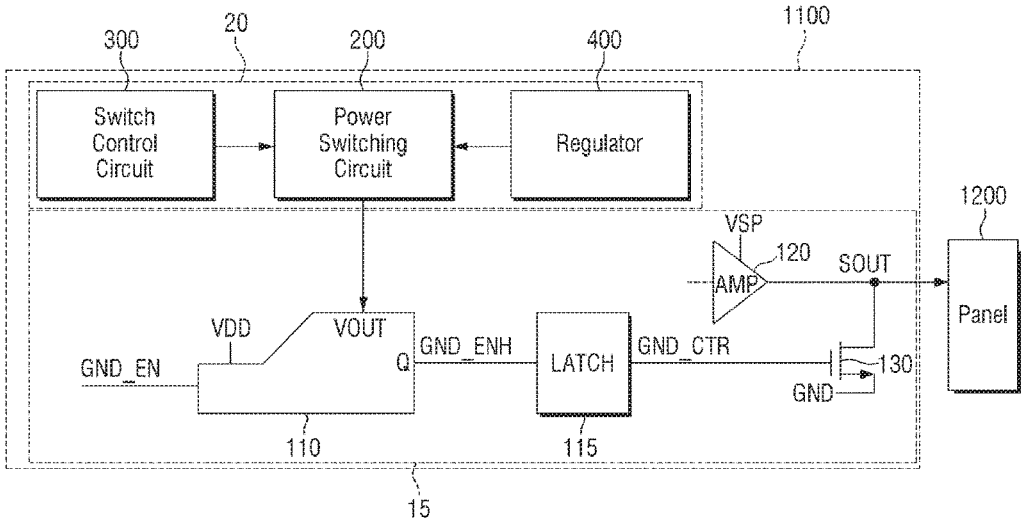
FIG. 6 is a block diagram explaining a display driving circuit according to some example embodiments of inventive concepts.
Figure 7:
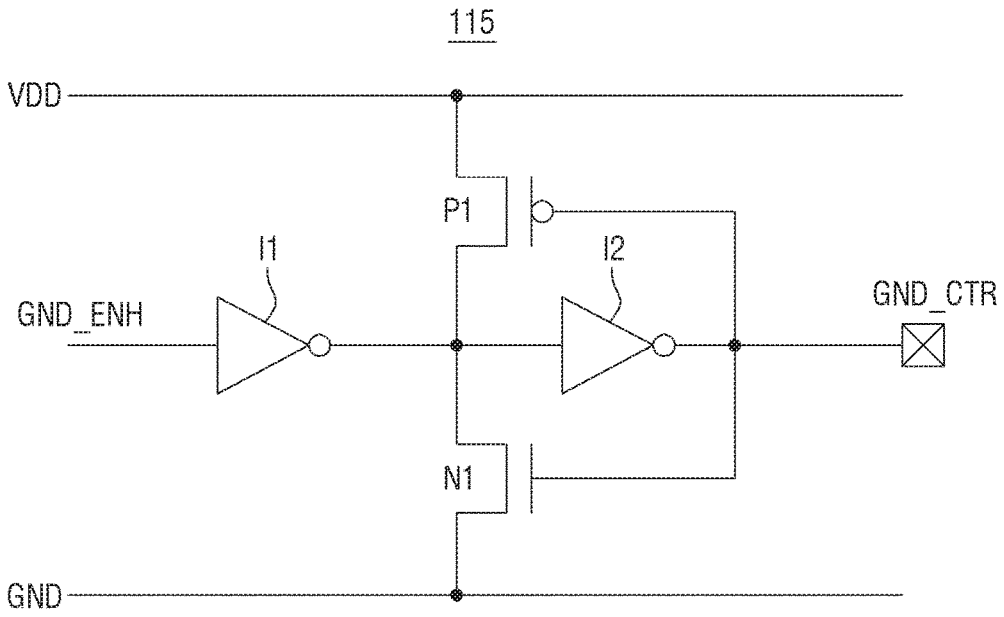
FIG. 7 is a circuit diagram explaining a latch circuit included in a display driving circuit according to some example embodiments of inventive concepts.

FIG. 6 is a block diagram explaining a display driving circuit according to some example embodiments of inventive concepts, and FIG. 7 is a circuit diagram explaining a latch circuit included in a display driving circuit according to some example embodiments of inventive concepts. Hereinafter, for convenience in explanation, duplicate explanation of the same items as those according to the above-described example embodiments will be omitted, and explanation will be made around the different point between the example embodiments.

Referring to FIGS. 6 and 7, a display driving circuit 1100 according to some embodiments of the present inventive concept may include substantially the same configuration and operation as those of the display driving circuit 1100 as described above with reference to FIGS. 2 to 5.

However, the display driving circuit 1100 according to some example embodiments of the inventive concepts may further include a latch circuit 115. The latch circuit 115 may be arranged between the level shift device 110 and the pull-down transistor 130 to maintain the output signal GND_ENH of the level shift device 110. In the drawing, it is illustrated that the latch circuit 115 is separated from the level shift device 110, but is not limited thereto. The latch circuit 115 may be included in the level shift device 110.

The latch circuit 115 according to the example embodiments of inventive concepts has the same configuration as a general latch circuit that is known in the related art. For example, referring to FIG. 7, the latch circuit 115 may include two inverters I1 and I2 and two transistors P1 and N1.

The first inverter and the second inverter I2 may be connected in series to each other, and the output signal GND_ENH of the level shift device 110 may be applied to the first inverter I1 and the output of the first inverter I1 may be applied to the second inverter I2. The output GND_CTR of the second inverter I2 may be connected to a gate terminal of the pull-down transistor N1.

Here, a pull-up transistor P1 having one terminal connected to the logic voltage VDD and the other terminal connected between the first inverter I1 and the second inverter I2 and a pull-down transistor N1 having one terminal connected between the first inverter I1 and the second inverter I2 and the other terminal connected to the GND terminal may be added. The pull-up transistor P1 and the pull-down transistor N1 may be gated by the output GND_CTR of the second inverter I2. In this case, the pull-up transistor P1 may include a P-type transistor, and the pull-down transistor may include an N-type transistor. However, the latch circuit 115 according to the example embodiments of inventive concepts are not limited thereto.

FIG. 8 is a table explaining an operation of a display driving circuit according to some example embodiments of inventive concepts.

Referring to FIG. 8, in accordance with the operating mode of the display driving circuit 1100, combinations of the first to third input signals SD_VSP_VCISW_A, SD_VSP_VCISW_B, and SD_VSP_VCISW_C that are input to the switch control circuit 300 may differ.

Specifically, when the display driving circuit 1100 is in a normal mode, the second input signal SD_VSP_VCISW_B may have a logic value "0", and the first and third input signals SD_VSP_VCISW_A and SD_VSP_VCISW_C may have a logic value "1". In this case, referring to FIG. 4, outputs of the level shifters included in the first sub-control circuit 310 may have the logic value "0" in all. Then, referring to FIG. 3, the transistors PB1, PB2, and PB3 of the first sub-circuit 210 to which the output of the first sub-control circuit 310 is applied may be turned on in all, and the transistor NC2 may be turned off. Accordingly, the first selection power VSP may be applied to the first node N1.

In the same principle as described above, when the display driving circuit 1100 is in a standby (STB) mode or a deep-standby (DSTB) mode, the first input signal SD_VSP_VCISW_A may have a logic value "0", the second and the third input signals SD_VSP_VCISW_B, and SD_VSD_VCISW_C may have a logic value "1", and the second selection power VCI may be applied to the first node N1.

In the same manner, when the display driving circuit 1100 is in an abnormal mode, the third input signal SD_VSP_VCISW_C may have a logic value "0", the first and second input signals SD_VSP_VCISW_A and SD_VSP_VCISW_B may have a logic value "1", and the third selection power VCI1 may be applied to the first node N1. However, the present inventive concept is not limited thereto.

In this case, the operating mode of the display driving circuit 1100 may be determined based on the change of voltage levels of the first to third selection powers VSP, VCI, and VCI1.

Figure 9:
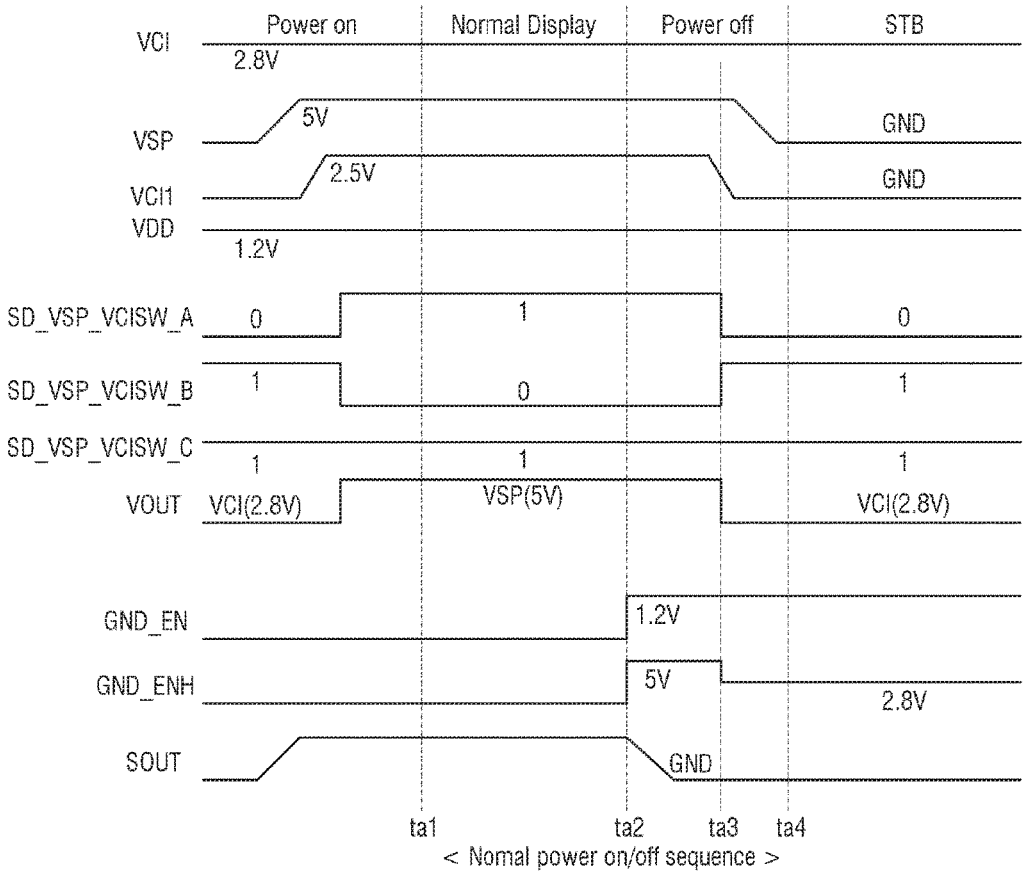
FIG. 9 is a timing diagram explaining an operation of a standby (STB) mode of a display driving circuit according to some example embodiments of inventive concepts.
Figure 10:
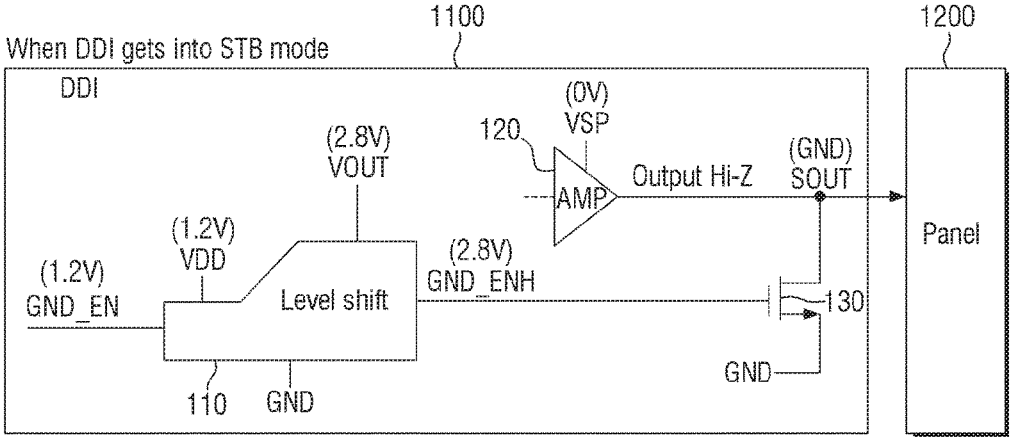
FIG. 10 is a block diagram explaining an operation of a standby (STB) mode of a display driving circuit according to some example embodiments of inventive concepts.

FIG. 9 is a timing diagram explaining an operation of a standby (STB) mode of a display driving circuit according to some example embodiments of inventive concepts, and FIG. 10 is a block diagram explaining an operation of a standby (STB) mode of a display driving circuit according to some example embodiments of inventive concepts.

Referring to FIG. 9, the display driving circuit 1100 operates in a normal mode through a power-on mode. In the normal mode, the first selection power VSP is applied to the level shift device 110, and a voltage that corresponds to image data to be output is applied to an input terminal SOUT of the display panel 1200. The voltage that is applied to the input terminal SOUT may differ depending on the kind of the image data to be output, and thus an image that is output through the display panel 120 may also differ.

In the case where the operating mode of the display driving circuit 110 is changed from a normal mode to a power-off mode by a user input, the second selection power VCI is maintained as it is, but the first selection power VSP and the third selection power VCI1 are pulled down. This is because the second selection power VCI corresponds to a power that is applied from an external power, and the first selection power VSP and the third selection power VCI1 correspond to voltages generated by the voltage generator. Accordingly, as the power is ended, the levels of the first selection power VSP and the third selection power VCI1 may be pulled down.

As the levels of the first selection power VSP and the third selection power VCI1 are pulled down, the operating mode of the display driving circuit 1100 is changed to a standby (STB) mode. In this process, a combination of the input signals SD_VSP_VCISW_A, SD_VSP_VCISW_B, and SD_VSP_VCISW_C that are applied to the switch control circuit 300 is changed, and the voltage that is applied to the level shift device 110 is also changed to the second selection power VCI.

Referring to FIGS. 9 and 10, the input signal GND_EN and the output signal GND_ENH of the level shift device 110 are enabled at time ta2 when the operating mode of the display driving circuit 1100 is changed to the power-off mode. In this case, the output signal GND_ENH is amplified by the level shift device 110, it may have a voltage level that is higher than the voltage level of the input signal GND_EN. For example, if a signal of a first level (1.2V) is input as the input signal GND_EN, the output signal GND_ENH may be amplified to a second level (5V) that is higher than the first level, but is not limited thereto.

As the output signal GND_ENH is enabled, the pull-down transistor 130 that is gated by the output signal is turned on, and the output terminal SOUT of the operational amplifier 120 may be discharged.

Then, at time ta3, the third selection power VCI1 is pulled down, and based on such a change of the selection power, a combination of the input signals SD_VSP_VCISW_A, SD_VSP_VCISW_B, and SD_VSP_VCISW_C that are applied to the switch control circuit 300 may be changed. Accordingly, the voltage that is provided from the power switching circuit 200 to the level shift device 110 may be changed from the first selection power VSP to the second selection power VCI. As the first source power VOUT that is input to the level shift device 110 is lowered from the first selection power VSP to the second selection power VCI, the voltage level of the output signal GND_ENH may also be lowered from the second level (5V) to a third level (2.8V) that is lower than the second level, but is not limited thereto.

Then, at time ta4, the display driving circuit 1100 is shifted to the standby (STB) mode, and even after both the first selection power VSP and the third selection power VCI1 are pulled down, the voltage of the second selection power VCI is maintained as it is. Since the second selection power VCI is applied to the level shift device 110, the output signal GND_ENH can be maintained in an enabled state. Accordingly, the pull-down transistor 130 is maintained in a turn-on state, and the output terminal SOUT of the operational amplifier 120 may be discharged for a sufficient time. FIG. 10 shows the operating state of the display driving circuit 1100 in the standby (STB) mode.

Through this, the display driving circuit 1100 can discharge a plurality of pixels that are included in the display panel 1200 for a sufficient time, and thus the DC residual effect can be prevented from occurring on the plurality of pixels. Further, the image sticking issue can also be prevented from occurring on the display panel 1200.

Figure 11:
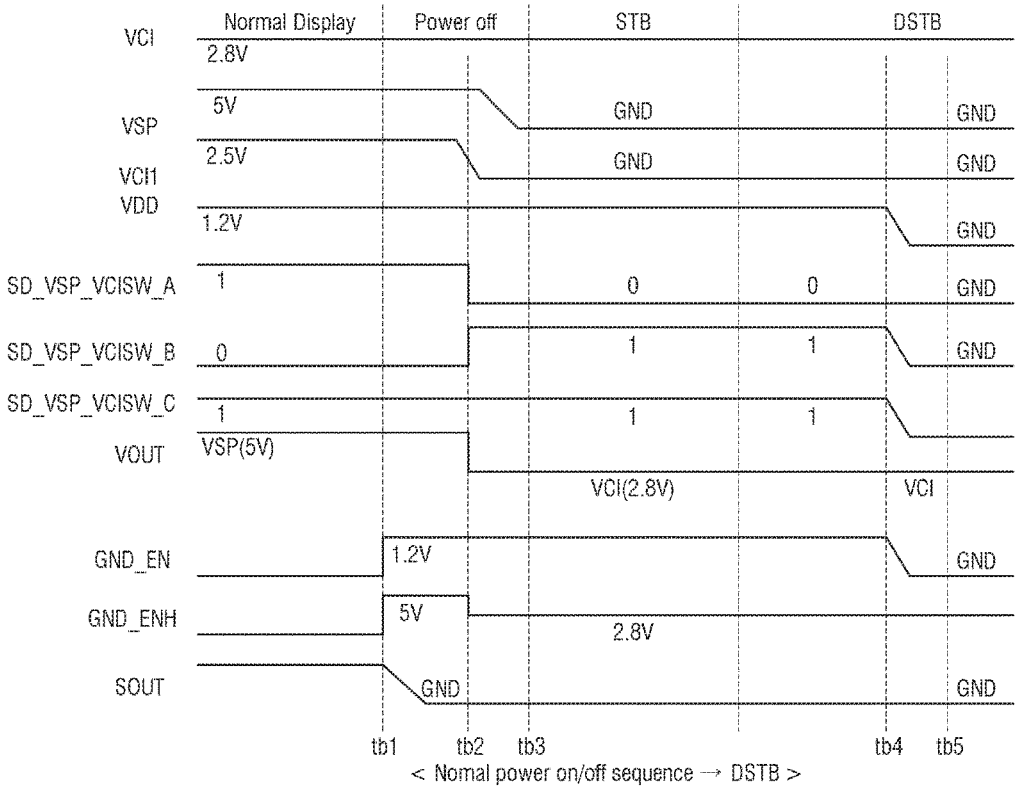
FIG. 11 is a timing diagram explaining an operation of a deep standby (DSTB) mode of a display driving circuit according to some example embodiments of inventive concepts.
Figure 12:
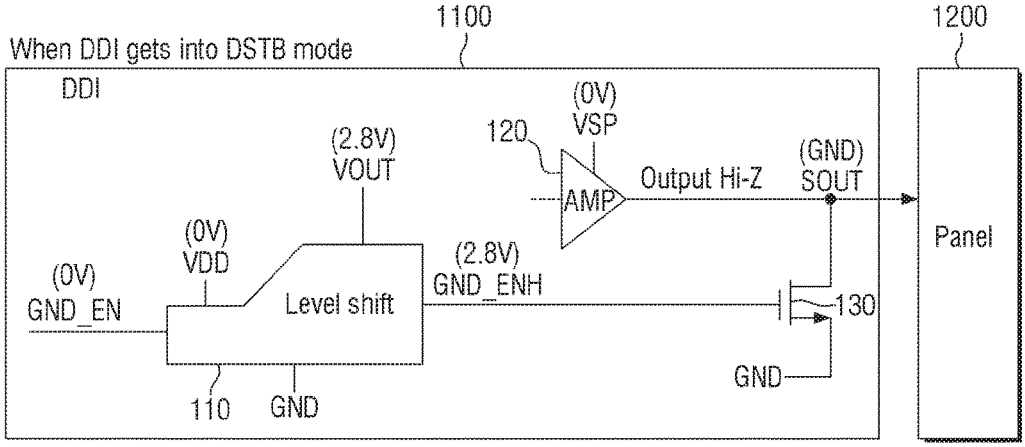
FIG. 12 is a block diagram explaining an operation of a deep standby (DSTB) mode of a display driving circuit according to some example embodiments of inventive concepts.

FIG. 11 is a timing diagram explaining an operation of a deep standby (DSTB) mode of a display driving circuit according to some example embodiments of inventive concepts, and FIG. 12 is a block diagram explaining an operation of a deep standby (DSTB) mode of a display driving circuit according to some example embodiments of inventive concepts. For convenience in explanation, duplicate explanation of the same items as those according to the above-described embodiment will be omitted, and explanation will be made around the different point between the embodiments.

Referring to FIGS. 11 and 12, the operating mode of the display driving circuit 1100 may be changed from the standby (STB) mode to a deep-standby (DSTB) mode. The process from the normal mode to the standby (STB) mode is the same as the contents as described above with reference to FIGS. 9 and 10.

As the operating mode of the display driving circuit 1100 is changed from the standby (STB) mode to the deep-standby (DSTB) mode, that is, as time goes by from time tb3 to time tb5, the voltage level of the second source power VDD is pulled down.

Accordingly, the input signals SD_VSP_VCISW_A, SD_VSP_VCISW_B, and SD_VSP_VCISW_C that are applied to the switch control circuit 300 may also be pulled down. However, even after the input signals SD_VSP_VCISW_A, SD_VSP_VCISW_B, and SD_VSP_VCISW_C are pulled down, the first source power VOUT that is applied to the level shift device 110 can be maintained as the second selection power VCI.

Since the second selection power VCI is continuously applied to the level shift device 110, the output signal GND_ENH of the level shift device 110 can be maintained in an enabled state. Accordingly, the pull-down transistor 130 can be maintained in a turn-on state, and the output terminal SOUT of the operational amplifier 120 can be discharged for a sufficient time. FIG. 12 shows the operating state of the display driving circuit 1100 in the deep-standby (DSTB) mode.

Through this, the display driving circuit 1100 can discharge the plurality of pixels included in the display panel 1200 for a sufficient time.

Figure 13:
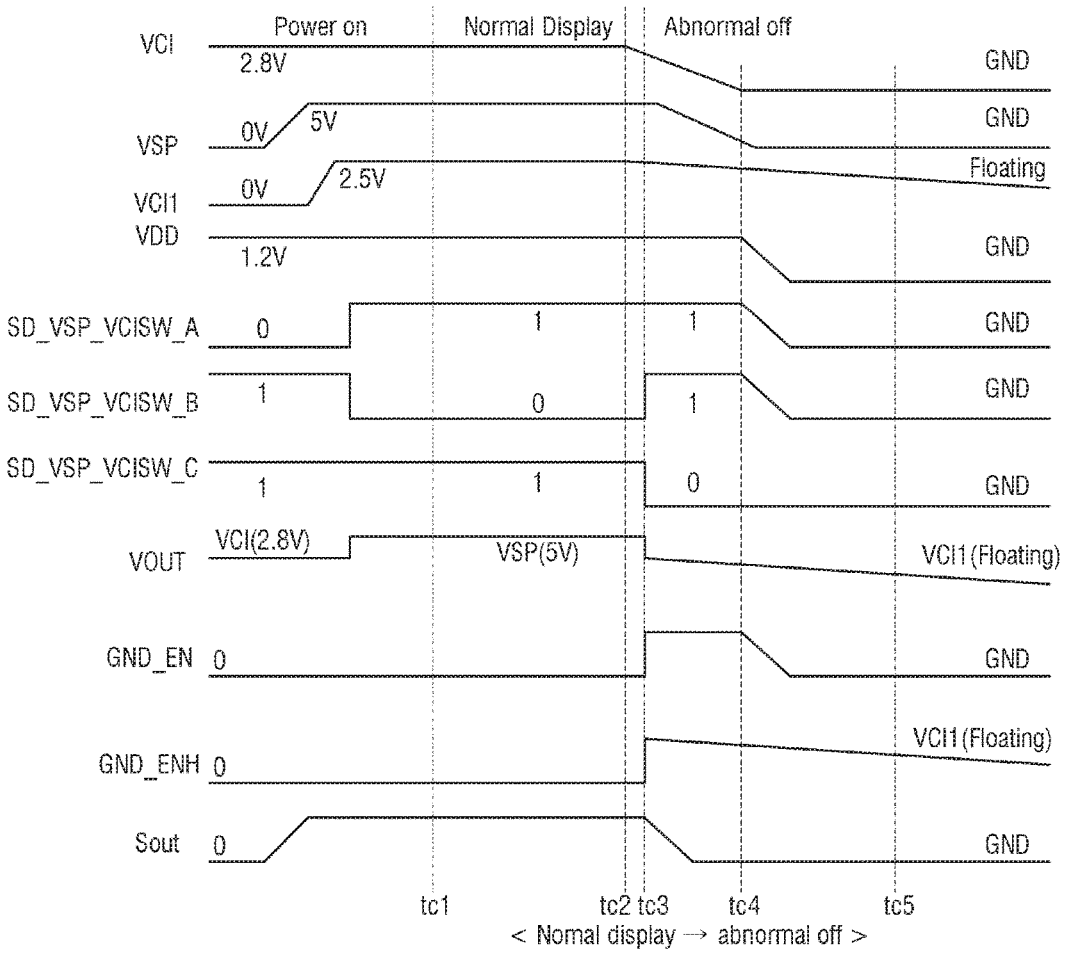
FIG. 13 is a timing diagram explaining an operation of an abnormal mode of a display driving circuit according to some example embodiments of inventive concepts.

FIG. 13 is a timing diagram explaining an operation of an abnormal mode of a display driving circuit according to some example embodiments of inventive concepts, and FIG.

14 is a block diagram explaining an operation of an abnormal mode of a display driving circuit according to some example embodiments of inventive concepts.

Referring to FIG. 13, the operation of a display device, which operates in a normal mode, may be abnormally ended due to an unexpected error occurrence. In this case, the display driving circuit 1100 operates in an abnormal mode.

In a normal mode, the first selection power VSP is applied to the level shift device 110, and a voltage that corresponds to image data to be output is applied to the input terminal SOUT of the display panel 1200.

Since the second selection power VCI is a power that is input from the outside, it maintains a constant value even in a standby (STB) mode or in a deep-standby (DSTB) mode. In the case where the second selection power VCI is lowered below a reference level (desired reference value), the display driving circuit 1100 operates in an abnormal mode.

At time tc3, the second selection power VCI is lowered below the reference level, and the first selection power VSP and the third selection power VCI1, which are generated by the second selection power VCI, are pulled down together.

However, unlike the first selection power VSP, the third selection power VCI1 is generated and output by the regulator 400, and in an abnormal mode, the change amount of the third selection power VCI1 may be smaller than the change amount of the first or second selection power VSP or VCI.

Specifically, referring again to FIG. 5, the control signal CVI1_ABN that is input to the regulator 400 may be non-enabled in the abnormal mode, and a second transistor 404 for connecting the second node N2 and the third node N3 to each other may be turned off.

Then, the second node N2 may be pulled down as the first transistor 408 is turned on, but the voltage of the third node N3 may become equal to the voltage of the charged capacitor. That is, as the second transistor 404 is turned off, the charge that is stored in the capacitor is discharged at low speed, and the voltage that is charged in the capacitor may be continuously transferred to the third selection power VCI1 as a floating power.

As the first selection power VSP and the second selection power VCI are pulled down, a combination of the input signals SD_VSP_VCISW_A, SD_VSP_VCISW_B, and SD_VSP_VCISW_C that are applied to the switch control circuit 300 is changed, and the voltage that is applied to the level shift device 110 is changed to the third selection power VCI1.

Referring again to FIGS. 13 and 14, at time tc3 when the operating mode of the display driving circuit 1100 is changed to the abnormal mode, the input signal GND_EN and the output signal GND_ENH of the level shift device 110 are enabled.

As the output signal GND_ENH is enabled, the pull-down transistor 130 that is gated by the output signal GND_ENH may be turned on, and the output terminal SOUT of the operational amplifier 120 may be discharged.

Then, at time tc4, the second source power VDD is pulled down, and thus the input signal GND_EN is also pulled down.

Figure 14:
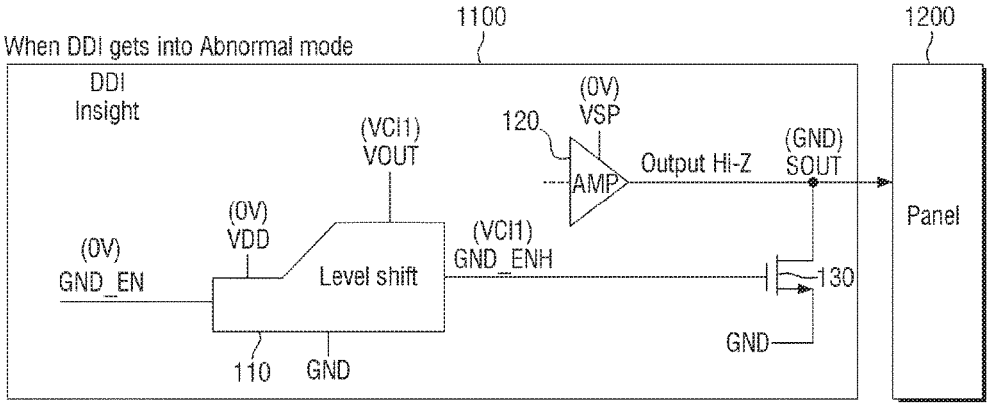
FIG. 14 is a block diagram explaining an operation of an abnormal mode of a display driving circuit according to some example embodiments of inventive concepts.

However, since the voltage of the third selection power VCI1 is maintained as it is in a floated state, the output signal GDN_ENH may be maintained in an enabled state. Accordingly, the pull-down transistor 130 is maintained in a turn-on state, and the output terminal SOUT of the operational amplifier 120 is discharged in a sufficient time even in the abnormal state where the external power is not supplied. FIG. 14 shows the operating state of the display driving circuit 1100 in the abnormal state. In this case, the slope of the output signal GND_ENH may be equal to the slope of the third selection power VCI1, but is not limited thereto.

Through this, the display driving circuit 1100 can discharge the plurality of pixels included in the display panel 1200 for a sufficient time, and can prevent the DC residual effect from occurring on the plurality of pixels. Further, it can prevent the image sticking issue from occurring on the display panel 1200.

Figure 15:
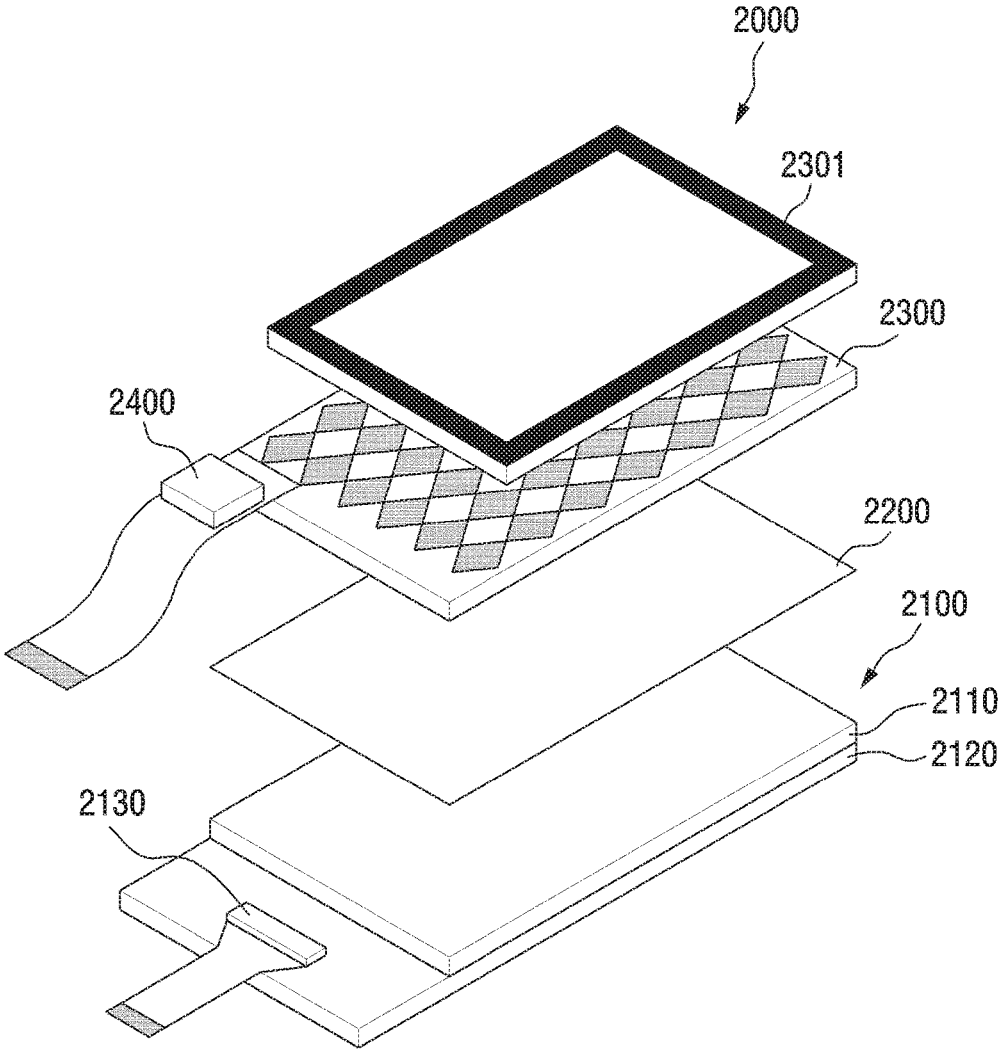
FIG. 15 is a view illustrating a display module according to some embodiments of inventive concepts.

FIG. 15 is a view illustrating a display module according to some embodiments of the present inventive concept.

Referring to FIG. 15, a display module 2000 may be provided with a display device 2100, a polarizing plate 2200, and a window glass 2301. The display device 2100 includes with a display panel 2110, a printed circuit board 2120, and a display driving chip 2130.

The window glass 2301 can be made of a material, such as acryl or tempered glass, to protect the display module 2000 from an external impact or scratch due to repeated touch. The polarizing plate 2200 may be provided for better optical characteristics of the display panel 2110. The display panel 2110 may be formed by patterning a transparent electrode on the printed circuit board 2120. The display panel 2110 includes a plurality of pixel cells to display a frame. According to an example embodiment, the display panel 2110 may be an organic light emitting diode panel. Each pixel cell includes an organic light emitting diode that emits light corresponding to a current flow, but is not limited thereto. The display panel 2110 may include various kinds of display elements. For example, the display panel 2110 may be one of a liquid crystal display (LCD), an electrochromic display (ECD), a digital mirror device (DMD), an actuated mirror device (AMD), a grating light value display (GIN), a plasma display panel (PDP), an electroluminescent display (ELD), a light emitting diode (LED) display, and a vacuum fluorescent display (VFD).

The display driving chip 2130 may include the display driving circuit 1100 as described above. In this example embodiment, the display driving chip 2130 is illustrated as one chip, but is not limited thereto. A plurality of driving chips may be mounted as the display driving chip 2130. Further, the display driving chip 2130 may be mounted on the printed circuit board 2120 of a glass material in a COG (Chip On Glass) form. However, this is merely example, and the display driving chip 2130 may be mounted in various forms, such as COF (Chip On Film) and COB (Chip On Board).

The display module 2000 may further include a touch panel 2300 and a touch controller 2400. The touch panel 2300 may be formed by patterning a transparent electrode, such as ITO (Indium Tin Oxide) on a glass substrate or a PET (Polyethylene Terephthalate) film. A touch controller 2400 senses the occurrence of a touch on the touch panel 2300, calculates touch coordinates, and transfers the calculated touch coordinates to the host. The touch controller 2400 may be integrated into one semiconductor chip together with the display driving chip 2130.

Figure 16:
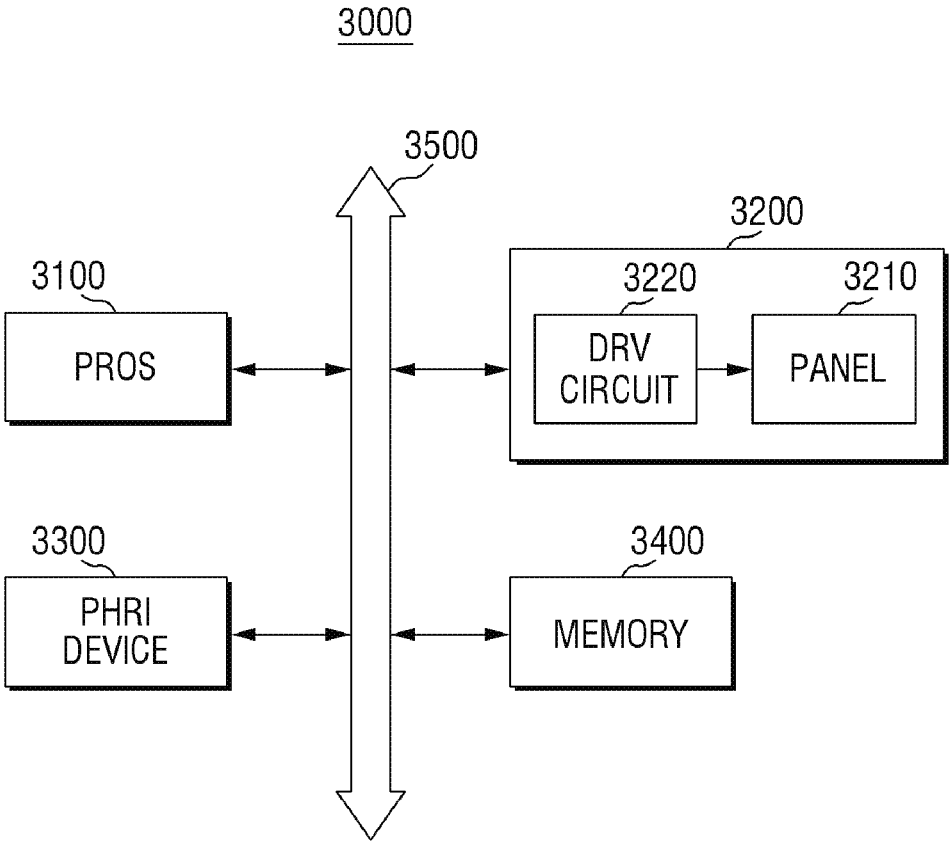
FIG. 16 is a diagram illustrating a display system according to some embodiments of inventive concepts.

FIG. 16 is a diagram illustrating a display system according to some example embodiments of inventive concepts.

Referring to FIG. 16, a display system 3000 may include a processor 3100, a display device 3200, a peripheral device 3300, and a memory 3400 which are electrically connected to a system bus 3500.

The processor 3100 may control input/output of data of the peripheral device 3300, the memory 3400, and the display device 3200, and may perform image processing of video data that is transmitted between the devices as described above.

The display device 3200 includes a panel 3210 and a driving circuit 3220. The display device 3200 stores video data applied through the system bus 3500 in the frame memory included in the driving circuit 3220, and displays the video data on the panel 3210. The display device 3200 may be the display device 1000 of FIG. 1. Accordingly, the display device 3200 operates in asynchronous with the processor 3100, and thus systematic burden of the processor 3100 can be reduced.

The peripheral device 3300 may be a device that converts a moving image or a still image into an electrical signal, such as a camera, a scanner, or a web cam. Video data that is acquired through the peripheral device 3300 may be stored in the memory 3400 or may be displayed on the panel of the display device 3200 in real time.

The memory 3400 may include a volatile memory, such as a DRAM, and/or a nonvolatile memory, such as a flash memory. The memory 3400 may be composed of a DRAM, a PRAM, a MRAM, a ReRAM, a NOR flash memory, a NAND flash memory, or a fusion flash memory (e.g., memory in which a SRAM buffer, a NAND flash memory, and a NOR interface logic are combined). The memory 3400 may store video data that is acquired from the peripheral device 3300 or a video signal that is processed by the processor 3100.

The display system 3000 according to an example embodiment of inventive concepts may be provided in a mobile electronic product, such as a smart phone, but is not limited thereto. The display system 3000 may be provided in various kinds of electronic products that display images.

Although preferred example embodiments of inventive concepts have been described for illustrative purposes, those skilled in the art will appreciate that various modifications, additions and substitutions are possible, without departing from the scope and spirit of the inventive concepts as disclosed in the accompanying claims.

What is claimed is:

1. A display driving circuit comprising:

a level shift circuit including a level shift device, the level shift device configured to, receive a source power applied thereto, and generate an output signal by amplifying an input signal;

a power switching circuit configured to provide any one of first to third selection powers as the source power to the level shift device, the first to third selection powers being different from one another; and a switch control circuit configured to change the first selection power to the second or third selection power based on a change of voltage levels of the first to third selection powers, wherein the level shift circuit includes, an operational amplifier configured to output source data to a display panel, and a pull-down transistor configured to be gated by the output signal of the level shift device, and selectively connect an output terminal of the operational amplifier to a ground terminal.

2. The display driving circuit of claim 1, wherein the power switching circuit comprises:

a first sub-circuit configured to provide the first selection power to a first node of the level shift circuit, a second sub-circuit configured to provide the second selection power to the first node, and a third sub-circuit configured to provide the third selection power to the first node.

3. The display driving circuit of claim 2, wherein the first sub-circuit comprises a first sub-transistor having one terminal connected to the first selection power, a second sub-transistor connected in series to the first sub-transistor, a third sub-transistor having a terminal connected to the second sub-transistor and another terminal connected to the first node, and a fourth sub-transistor having one terminal connected between the first sub-transistor and the second sub-transistor and another terminal connected to a ground terminal.

4. The display driving circuit of claim 1, further comprising:

a regulator configured to generate the third selection power based on the second selection power and to provide the generated third selection power to the power switching circuit.

5. The display driving circuit of claim 4, wherein the regulator comprises:

an operational amplifier configured to receive an input of the second selection power and to output a converted voltage to a second node, a first transistor configured to be gated by the input signal of the level shift device and to selectively connect the second node to a ground terminal, a second transistor configured to be gated by a control signal based on the change of the voltage levels of the first to third selection powers and to selectively transfer a voltage of the second node to a third node, and a capacitor connected between the third node and the ground terminal.

6. A display driving circuit comprising:

a level shift circuit including, a level shift device configured to receive first and second source powers that are different from each other, and generate an output signal by amplifying an input signal, and an operational amplifier configured to output source data to a display panel;

a pull-down transistor configured to be gated by the output signal of the level shift device, and to selectively connect an output terminal of the operational amplifier to a ground terminal;

a power switching circuit configured to provide any one of first to third selection powers that are different from one another as the first source power of the level shift device; and a switch control circuit configured to determine an operating mode based on a change of voltage levels of the first and second source powers, and to change the first source power applied to the level shift circuit by changing a control signal for controlling the power switching circuit if the operating mode changes.

7. The display driving circuit of claim 6, wherein the operating mode of the display driving circuit includes first to third modes of operation, the power switching circuit is configured to apply, the first selection power to the level shift circuit as the first source power, in the first mode of operation, and the second selection power to the level shift circuit as the first source power if the operating mode is changed from the first mode to the second mode.

8. The display driving circuit of claim 7, wherein the level shift circuit is configured to pull down the second source power and the input signal, such that the output signal maintains a same value as the second mode of operation if the operating mode is changed from the second mode to the third mode of operation.

9. The display driving circuit of claim 6, wherein the operating mode includes a normal mode and an abnormal mode, and the power switching circuit is configured to apply, the first selection power to the level shift circuit as the first source power in the normal mode, and the third selection power to the level shift circuit as the first source power in the abnormal mode.

10. The display driving circuit of claim 9, wherein, if the operating mode is change from the normal mode to the abnormal mode, the level shift circuit is configured to enable the input signal, pull down the input signal together with the second source power, and change a value of the output signal to have a slope that is equal to a slope of the third selection power.

11. The display driving circuit of claim 9, wherein, if the operating mode is changed from the normal mode to the abnormal mode, the level shift circuit is configured to, turn on the pull-down transistor, and discharge an output terminal of the operational amplifier.

12. A display device comprising:

a display panel including a plurality of pixels; and a display driving circuit configured to control the display panel, the display driving circuit includes, a voltage generator configured to receive a power supply voltage from an outside of the display driving circuit and to generate first to third selection powers that are different from each other;

a level shift device configured to receive any one of the first to third selection powers, and generate an output signal by amplifying an input signal;

a pull-down transistor configured to be gated by the output signal of the level shift device and selectively connect the display panel to a ground terminal to pull down the plurality of pixels; and a switch control circuit configured to change a selection power that is applied to the level shift device to another selection power based on a change of voltage levels of the first to third selection powers, wherein the level shift device includes an operational amplifier that is configured to output source data to the display panel.

13. The display device of claim 12, wherein the display driving circuit further comprises a source driver, the source driver configured to control data lines connected to the plurality of pixels, and the source driver includes the level shift device, the pull-down transistor, and the switch control circuit.

14. The display device of claim 12, wherein the display driving circuit further comprises:

a first sub-circuit configured to transfer the first selection power to a first node, the first node is in the level shift device, a second sub-circuit configured to transfer the second selection power to the first node, and a third sub-circuit configured to transfer the third selection power to the first node.

* * * * *